United States Patent [19]

Fleming et al.

[11] 4,322,695

[45] Mar. 30, 1982

[54] PLANAR TRANSMISSION LINE ATTENUATOR AND SWITCH

[75] Inventors: Paul L. Fleming, Rockville; Thane Smith, Middletown, both of Md.

[73] Assignee: Communications Satellite Corporation, Washington, D.C.

[21] Appl. No.: 107,111

[22] Filed: Dec. 26, 1979

Related U.S. Application Data

[63] Continuation-in-part of Ser. No. 904,966, May 11, 1978, abandoned.

[51] Int. Cl.[3] ..... H01P 1/15

[52] U.S. Cl. ..... 333/104; 333/81 A; 333/262; 357/15

[58] Field of Search ..... 333/101, 103, 104, 81 A, 333/262; 357/15

[56] References Cited

U.S. PATENT DOCUMENTS

| | | | |
|---|---|---|---|
| 3,432,778 | 3/1969 | Ertel | 333/81 A |
| 3,475,700 | 10/1969 | Ertel | 333/104 |
| 3,684,902 | 8/1972 | Giuliano | 357/15 X |
| 3,774,123 | 11/1973 | Hume | 333/104 |
| 3,833,866 | 9/1974 | Boutelant | 333/104 |
| 3,975,690 | 8/1976 | Fleming | 357/3 X |
| 4,245,230 | 1/1981 | Kwok et al. | 357/15 |

*Primary Examiner*—Paul L. Gensler

*Attorney, Agent, or Firm*—Sughrue, Mion, Zinn, Macpeak and Seas

[57] ABSTRACT

The planar transmission line attenuator and switch is formed on a flat piece of semiconductor material. Transmission line metallic conductors are deposited on a flat surface of the semiconductor material, and at least one of the metallic conductors forms a Schottky barrier contact to this flat semiconductor surface. The gap between the metallic conductors defines a shunt current path through the semiconductor material. The semiconductor material at the surface in contact with the transmission line conductor must be conductive. By applying a bias voltage to the metallic conductor forming the Schottky barrier contact, the conductivity of the shunt path can be controlled by changing the depletion layer width across the Schottky barrier. A plurality of planar transmission line switches can be combined into multiport networks, examples of which are cross-bar switching devices and $\beta$ element switching devices.

5 Claims, 12 Drawing Figures

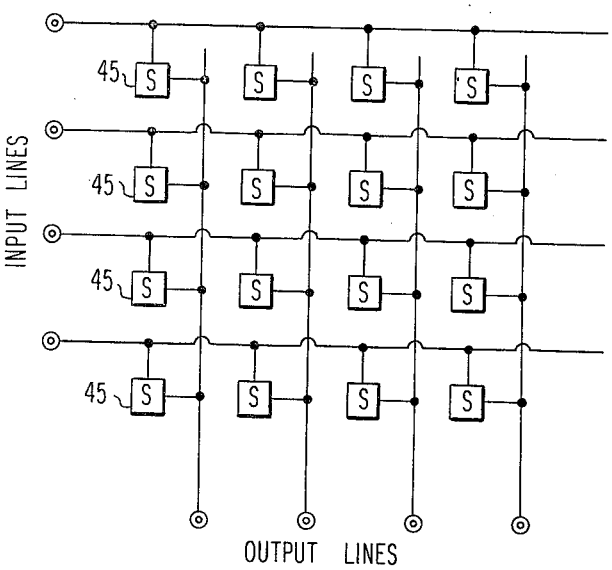
FIG. 9
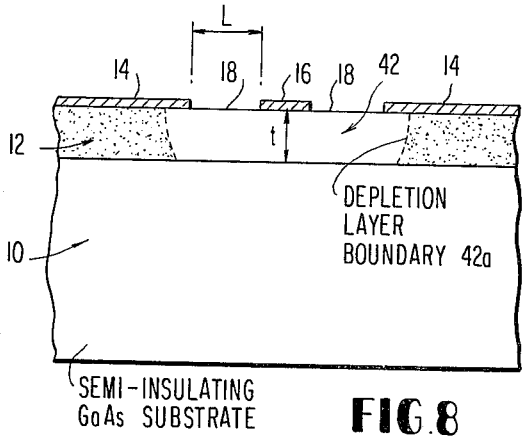
FIG. 8
FIG. 11
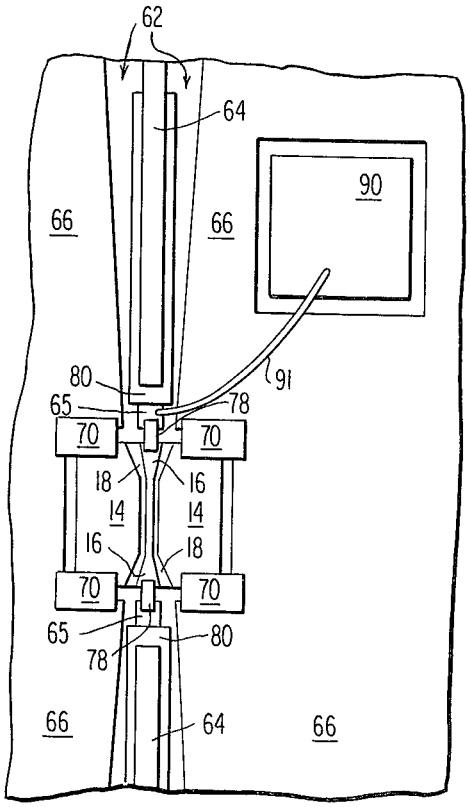
FIG. 10
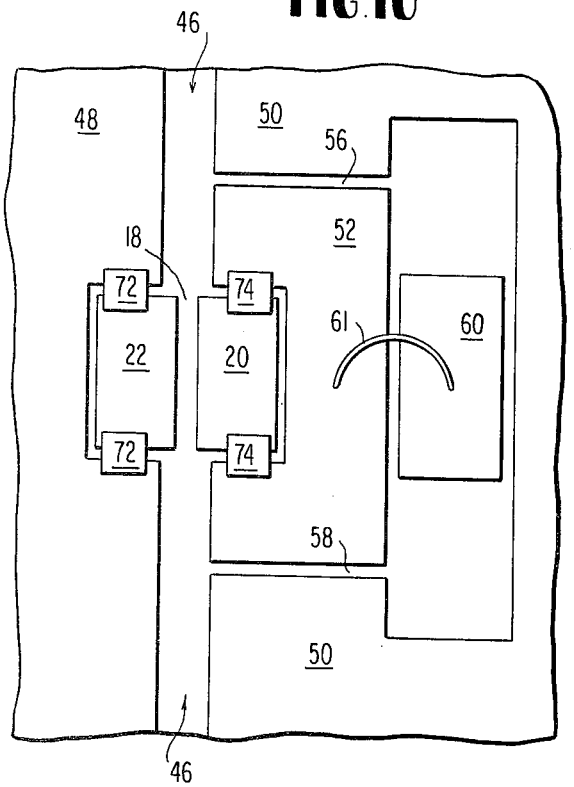
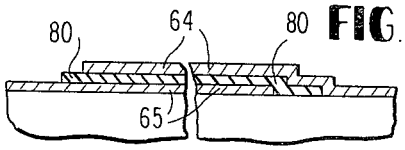
FIG. 12

PLANAR TRANSMISSION LINE ATTENUATOR AND SWITCH

BACKGROUND OF THE INVENTION

This application is a continuation in part application of U.S. application Ser. No. 904,966 filed May 11, 1978 now abandoned.

The present invention generally relates to r.f. switching devices, and more particularly to r.f. switching devices formed by sections of transmission lines in which the attenuation can be switched from high values, such as 60 dB, to low values, such as 5 dB or 0 dB. The invention also relates to the use of such transmission line switches in multi-port networks such as microwave cross-bar switches and $\beta$ switching devices.

At the present time, microwave switching is accomplished mostly by means of PIN diodes which function by changing their conductance and capacitance in response to a change in bias voltage. To act as a switch, PIN diodes must be combined with other passive elements in a circuit attached in some way to a transmission line. The circuit must be carefully designed to provide the desired attenuation and VSWR in the off state and in the on state. The primary disadvantages of this type of switching element are its relatively high complexity and narrow bandwidth. The bandwidth is usually limited because a reactance change in the PIN diode is used to achieve the switching function.

The planar transmission line attenuator and switch according to this invention has certain similarities in construction to the device disclosed in U.S. Pat. No. 3,975,690 to Paul L. Fleming, one of the co-inventors of the present invention. The Fleming patent discloses a planar transmission line comprising a Gunn effect semiconductor on which transmission line conductors are deposited. This device can be used to either amplify of switch r.f. signals. When used as a switch, the device is operated under conditions so as not to exhibit gain. Near zero attenuation is achieved in either of two ways. The product of carrier concentration, N, times the electric field length, L, between the conductors is made high enough so that at the on state bias, the field configuration is such that over most of the current path the field is near the threshold field. This is the field at which the differential mobility, $\mu$, or the slope, dv/dE, of the velocity versus field curve (see FIG. 2 of the Fleming patent) is zero. A short segment of the current path has a much higher field where $\mu$ is also near zero. In the short transition between these two regions, $\mu$ is negative and as a result the shunt conductivity per unit length, G, may be negative for some frequencies but will not have sufficiently large magnitude to overcome the series resistance losses in the metallic conductors. The product N·t, where t is the thickness of the conductive semiconductor layer, must be kept below about $5\times10^{11}$ to prevent small signal instability leading to spontaneous oscillation. The other way of using the Gunn effect is to allow a significant, negative value of $\mu$ over most of the current path but keeping the resulting negative conductivity small by making the thickness or carrier concentration of the conductive semiconductor layer small. The value of conductivity, G, could be adjusted to achieve exactly zero attenuation at a particular operating frequency.

While the device according to the Fleming patent can provide excellent switching results in certain applications, it has the disadvantage of high d.c. power dissipation. This becomes a serious problem when a great many of these devices are arranged in a matrix to form a a cross-bar switch, for example.

U.S. Pat. No. 3,432,788 to Ertel discloses a microstrip transmission line with variable attenuation which can be achieved by making either the ground plane or the strip conductor form a Schottky barrier contact to the semiconductor which serves as the transmission line substrate. Variation of the bias voltage between the strip conductor and ground plane varies the shunt conductivity of the microstrip transmission line which in turn varies the attenuation. The Ertel device has a limited range of attenuation which is too small for the device to be of much use as a switch. In order to achieve, in a single transmission line variable attenuator, both a very high maximum attenuation and a very low minimum attenuation by variation of the shunt conductivity it is necessary that most of the power carried by the r.f. electro-magnetic fields be in a region having electrical conductivity which can be varied from very high to very low. If a suitable bias voltage is applied across a Schottky barrier a portion of the semiconductor adjacent to the Schottky barrier metal will be depleted of carriers. This is called a depletion layer. The depletion layer width is measured along an electric field line from the interface between the Schottky barrier metal and the semiconductor to the interface between the depleted and undepleted portions of the semiconductor. The electrical conductivity in the depletion layer is essentially zero. If the path of the r.f. shunt current in a transmission line passes through such a depletion layer, then the r.f. shunt conductivity varies with the depletion layer width. This shunt conductivity increases when the depletion layer width is decreased and decreases when the depletion layer width is increased. If all of the r.f. shunt current is through a depleted region of the semiconductor, then the loss of the transmission line is due only to the series resistance in the metal conductors. The depletion layer width varies from zero at a forward bias voltage above the "built-in" barrier potential to a maximum at a reverse bias equal to the avalanche breakdown voltage. As the conductivity of a semiconductor is increased by increasing its carrier concentration both the depletion layer width for a particular bias across a Schottky barrier and the magnitude of the avalanche breakdown voltage decrease. This means that the maximum possible depletion layer width decreases with increasing semiconductor conductivity. To construct a microstrip line according to the Ertel invention using a high conductivity semiconductor as the transmission line substrate, all of which can be depleted of carriers, would require such a thin piece of semiconductor that it would be very fragile and would not be self supporting. Thus a high ratio of maximum to minimum attenuation is not possible in practice for the Ertel invention. Using a thin high conductivity semiconductor layer on a high resistivity substrate does not help in the microstrip structure because in the off state most of the r.f. shunt current path in that case would not be through high conductivity material.

The planar transmission line attenuator and switch according to the present invention overcomes the difficulties mentioned above and allows high ratios of maximum to minimum attenuation to be achieved. This is accomplished through use of planar transmission line formed by one or more gaps between metal conductors deposited on a flat piece of semiconductor material which serves as the transmission line substrate. (Two planar transmission line are the slot line disclosed in U.S. Pat. No. 3,688,255 to S. B. Cohn, and the coplanar waveguide disclosed in U.S. Pat. No. 3,560,895, to C. P. Wen.) The semiconductor material acting as the transmission line substrate would normally be chosen to be mostly a very high resistivity slab, called the semiconductor substrate, and preferably have a thin layer of the same semiconductor doped to high conductivity between the high resistivity semiconductor substrate and the metal conductor.

The coplanar wave guide transmission line is particularly advantageous because its characteristic impedance depends only on the ratio of the center conductor width to the ground plane separation, and not on the substrate thickness. Because of this the gap width, characteristic impedance, and substrate thickness can be chosen independently of one another. If the high conductivity layer thickness is chosen to be one to two times the gap width in either type of transmission line, then most of the power carried by the r.f. electromagnetic fields will be in this layer. (This may be shown by use of the conformal transmission discussed by C. P. Wen in a paper entitled "Coplanar Wave Guide: A Surface Strip Transmission Line Suitable for Nonreciprocal Gyromagnetic Device Applications," IEEE Trans, MIT-17, 1087, (1969).) If both the high conductivity layer thickness and the gap width are chosen to be less than the depletion layer width at the avalanche breakdown voltage in the high conductivity layer, then nearly all of the semiconductor region containing significant r.f. power density can be depleted when one or more of the conductors makes Schottky barrier contact to the semiconductor and a suitable d.c. bias voltage is applied (see FIG. 8). Thus, by choosing the dc bias voltage the r.f. shunt conductivity can be made very low (at the maximum depletion layer width) or very high (at very small or zero depletion layer width). These are exactly the conditions given above for obtaining in the same transmission line variable attenuator both very high maximum attenuation and very low minimum attenuation. If the gap width is chosen as above, but the high conductivity layer is thicker than the depletion layer width, or if the substrate is not high resistivity, or if the entire transmission line substrate has the same conductivity then only a small increase in the minimum attenuation results because, most of the power carried by the r.f. electromagnetic fields is confined within a depth of one to two gap widths below the plane of the metal conductors.

SUMMARY OF THE INVENTION

The transmission line attenuator and switch according to the present invention exhibits a wide range of attenuation over a very broad bandwidth, and this is accomplished with a very simple structure. Thus, the transmission line attenuator and switch according to this invention has neither the complexity nor narrow bandwidth which are common in microwave switches using PIN diodes. At the same time, the transmission line attenuator and switch according to the present invention is to be distinguished from the device disclosed in the Fleming patent in that the invention is characterized by making one or more of the metallic conductors to form a Schottky barrier contact to the semiconductor on which it is deposited. Use is made of the change in the depletion layer width with bias voltage across the Schottky barrier to vary the shunt conductivity of the transmission line. More specifically, the depletion layer is defined as a layer in the semiconductor adjacent the Schottky barrier metal contact, and this layer contains no free carriers and is therefore said to be depleted. If the bias voltage across the depletion layer is zero, then the width of the depletion layer is small. A forward bias reduces the depletion layer width, and a reverse bias increases it.

The carrier concentration in the semiconductor near the metal conductors of the transmission line and the width of the gap or gaps between conductors forming the transmission line are chosen such that at zero bias most of the shunt current path is through undepleted semi-conductor, while at an appropriate reverse bias, most of this path is through the depletion layer. (In a preferred embodiment, a semiconductor high conductivity active layer is formed below the metal conductors on a high resistivity semiconductor substrate.) This results in high attenuation at a small forward bias and much lower attenuation at the reverse bias.

The width of the gap or gaps between conductors of this planar transmission line is chosen to be less than or equal to the depletion layer width at the avalanche breakdown voltage for the semiconductor layer on which the conductors are deposited. For maximum attenuation at forward bias the the semiconductor on which the planar transmission line is deposited should have high conductivity for a distance from the metal conductors of at least one to two times the width of gap or gaps between the conductors of the transmission line. For minimum attenuation at an appropriate reverse bias the high conductivity semiconductor should be in the form of a layer on a semiconductor substrate of high resistivity compared to that of the high conductivity semiconductor layer, and the thickness of the high conductivity layer should be less than or equal to the width of the depletion layer at the avalanche breakdown voltage of the high conductivity layer. Also for minimum attenuation in this condition series resistance per unit length of the transmission line conductors must be made small by appropriate choice of metals and metal thickness.

BRIEF DESCRIPTION OF THE DRAWINGS

The invention will be better understood from the following detailed description with reference to the accompanying drawings, in which:

FIG. 8 is a cross section view illustrating a planar transmission line attenuator and switch according to the present invention, and showing the relation between the depletion layer dimensions at the avalanche breakdown voltage in the case where a high resistivity semiconductor substrate and a high conductivity semiconductor layer are used.

FIG. 9 is a circuit diagram of a cross-bar switch employing the invention.

FIGS. 10 and 11 are schematic plan views illustrating two ways of constructing the switching elements used in a cross-bar switch employing the invention.

FIG. 12 is a cross section view of one of the d.c. blocking capacitors used in the center conductors of the coplanar waveguide input and output lines to the switching element shown in FIG. 11.

DETAILED DESCRIPTION OF THE INVENTION

Figure 1:
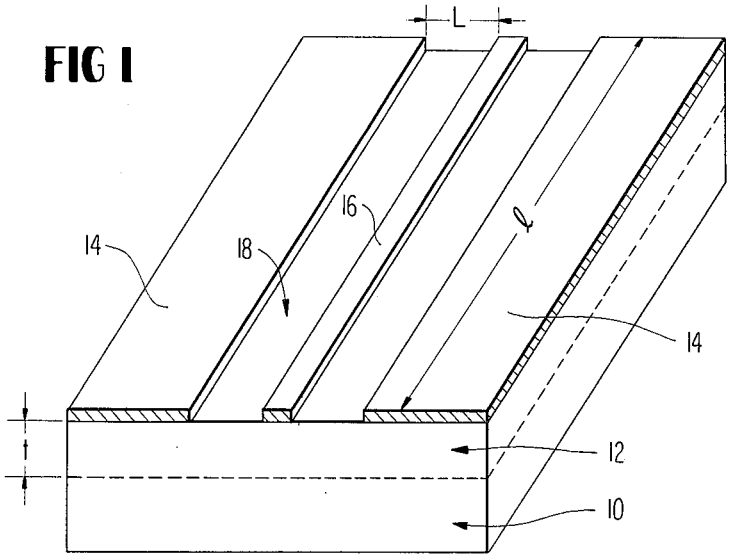
FIG. 1 is a perspective view illustrating a planar transmission line attenuator and switch according to one embodiment of the present invention.

As shown in FIGS. 1 and 8, the transmission line attenuator and switch comprises a transmission line substrate which may have a planar surface and consisting of a semiconductor material 10 called the semiconductor substrate and in the preferred embodiment shown, over which is formed a thin, conductive semiconductor layer 12. The semiconductor layer 12 has a carrier concentration, N, and mobility, $\mu$, and a thickness t. For lowest minimum attenuation the semiconductor substrate 10 has a resistivity which is very high compared to that of the semiconductor layer 12 so that electric power is dissipated only in the conductive semiconductor layer 12.

Gallium arsenide is a preferred semiconductor material, but in addition to the semiconductor materials mentioned in the Fleming patent, silicon may also be used. The semiconductor layer 12 is preferably formed by epitaxial growth on the base substrate material 10.

The transmission line illustrated in FIGS. 1 and 8 is a three conductor transmission line comprising ground planes 14 and a center conductor 16. These metallic conductors are deposited on the planar surface of the semiconductor layer 12 so as to form a uniform gap 18 between the ground plane conductors 14 and the center conductor 16. The gap 18 defines a gap width L between the center conductor 16 and the ground plane conductors 14. The semiconductor 12 has a shunt conductivity per unit length, G, which is proportional to the sheet conductance, N $\mu$et (where e is the magnitude of the elementary charge), divided by the gap width, L, since the r.f. drift current flows across the gap 18 (or gaps) between the conductors. This shunt conductivity causes an attenuation per unit length which can be large compared to that due to the series resistance of the metallic conductors. To minimize the on-state loss the conductor metals and their thickness should be chosen to minimize their series resistance.

Figure 2:
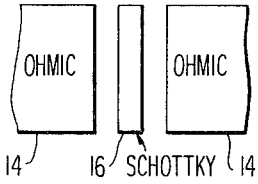
FIGS. 2 to 6 are schematic plan views illustrating several alternative embodiments of the transmission line attenuator and switch according to the invention.
Figure 3:
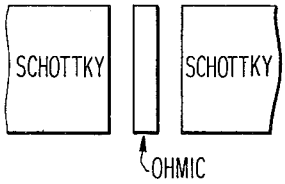
Figure 4:
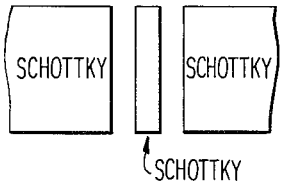
Figure 5:
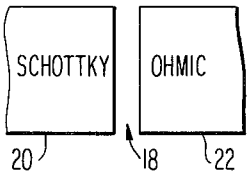
Figure 6:
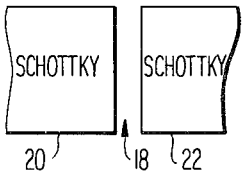

In order to bring the value of G to zero or close to zero and thus greatly reduce the attenuation per unit length, one or more of the metallic conductors 14 and 16 are made to form a Schottky barrier contact to the semiconductor layer 12. As shown in FIG. 2, the center conductor 16 can be made to form the Schottky barrier, while the ground plane conductors 14 may be made to make an ohmic contact with the semiconductor layer 12. Alternatively, the center conductor 16 may make an ohmic contact and the ground plane conductors made to form Schottky barriers as illustrated in FIG. 3. It is also possible to make all three conductors form a Schottky barrier contact as shown in FIG. 4. Moreover, the invention is not limited to three conductor transmission lines but may also be realized with a slot line configuration. Such a configuration is schematically illustrated in FIGS. 5 and 6. In these figures, metallic conductors 20 and 22 are deposited on the semiconductor substrate to define a single gap 18. In FIG. 5, the metallic conductor 20 is made to form a Schottky barrier, while the metallic conductor 22 forms an ohmic contact with the semi-conductor. On the other hand in FIG. 6, both of the metallic conductors 20 and 22 are made to form Schottky barriers with the semiconductor substrate.

The mechanism by which the present invention operates is the change in the depletion layer width with bias voltage across the Schottky barrier, and is illustrated by FIG. 8 which illustrates the device of FIG. 1 in cross-section. The depletion layer 42 is a layer in the semiconductor adjacent the Schottky barrier metal contact 16, and this layer contains no free carriers and is therefore said to be depleted. Because the depletion layer contains no free carriers, an increase in the size of the depletion layer results in a decrease in attenuation of an r.f. signal propagated by the transmission line. This occurs when the depletion layer edge 42*a* reaches beyond the edge of the other transmission line conductors 14 as shown in FIG. 8. In other words, minimum attenuation occurs when a sufficient reverse bias (that is, negative bias if the carrier type in the semiconductor layer 12 is negative, or positive bias if the carrier type is positive) is applied to the Schottky barrier contact 16 to make the depletion layer 42 large enough to completely deplete that portion of the semiconductor layer 12 which would, when an r.f. signal is present, contain significant r.f. energy density, because then there are no free carriers in this region to absorb the r.f. signal being propagated by the transmission line. In contrast, when the bias voltage is slightly forward, the depletion layer no longer exists, resulting in high attenuation because of the r.f. signal absorption due to the high shunt conductivity in the semiconductor layer 12. The width of the gap or gaps 18 between conductors of this planar transmission line is chosen to be less than or equal to the width of the depletion layer 42 at the avalanche breakdown voltage for the semiconductor layer 12 on which they are deposited. For maximum attenuation at forward bias the semiconductor layer 12 on which the planar transmission line is deposited should have significant conductivity and should have a thickness of at least one or two times the width of gap or gaps 18. For minimum attenuation at an appropriate reverse bias the semiconductor substrate 10 should be high resistivity compared to that of layer 12, and the thickness of layer 12 should be less than or equal to the width of the depletion layer 42 at the avalanche breakdown voltage for layer 12, and the sheet resistivity of the metallic transmission line conductors should be as low as possible.

In an experimental model of the embodiment of FIG. 1, a planar transmission line switch having a 50 ohm characteristic impedance, and constructed as shown in FIG. 1, with L=5 $\mu$m, l=1550 $\mu$m, t=5 $\mu$m, and $N=1\times10^{15}$ $Cm^{-3}$ the attenuation was switched from a high value, such as 18 dB, at a forward bias voltage of 0.6 volts to a low value, such as 4 dB, for a reverse bias voltage of −20 volts. Because the width of the depletion layer can be controlled by the application of the bias voltage to the Schottky barrier contact 16, the transmission line according to this invention allows a control of the attenuation of an r.f. signal over a very wide range.

In another embodiment of the structure illustrated in FIG. 1, the semiconductor material 10 may be N+ type GaAs (gallium arsenide) where for example, $N=10^{18}$. With this structure, l=5 $\mu$m, t=10 $\mu$m, 1=1550 $\mu$m. In this embodiment, because of the thickness of the semiconductor layer 12, the depletion layer boundary about the Schottky contact 16 at avalanche breakdown is not wide enough to contact the interface between the N and N+ materials.

In another embodiment, contacts 14, 16 would be placed on a solid bulk slab of N-type semiconductor material, such as Gallium Arsenide (GaAs), rather than on a separate high-conductivity layer 12. In either this embodiment or that of the previous paragraph, the switch and attenuator device of the invention will operate with a higher on-state insertion loss than the former preferred embodiment previously discussed with respect to FIGS. 1 and 8 wherein the layer 12 is an N-type epitaxial layer the layer 10 is of a semi-insulating GaAs substrate; however, the off-state loss for the latter embodiments would be at least as high as that of the former embodiment. In all embodiments discussed herein, including those of FIGS. 2 to 7, it is important to note that to operate in accordance with the principles of this invention, when the Schottky contact is reversed-biased, in the material underlying the contact and forming the gap between the biased Schottky contact and the non-biased contact (e.g. 12 and 14 in FIG. 1), the gap is entirely depleted at avalanche breakdown.

The lower power consumption of the transmission line switches according to the present invention make them particularly attractive when combined into multi-port networks. One important application is a microwave cross-bar switch which can be used, for example, onboard a communication satellite. Such a cross-bar switch is made by providing a matrix of transmission line switches 45 according to this invention that are connected as shown in FIG. 9. Each of these transmission line switches would be switchable by selective application of bias voltages to connect corresponding row and column lines of the cross-bar switch. The individual planar transmission line switches 45 can be of the slot line construction as shown in FIG. 10 or of the coplanar waveguide construction as shown in FIG. 11. In FIG. 10 the input and output transmission lines to each transmission line switch is a slot line formed by a gap 46 between conductors 48 and 50 and between conductors 48 and 52 formed on a dielectric substrate (such as alumina or fused silica). Conductors 20 and 22 or a planar transmission line switch of the slot line construction as shown in FIG. 5 or 6 are respectively connected to conductors 52 and 48 by bonding straps 74 and 72. The conductor 52 on the dielectric substrate is separated from conductors 50 by narrow gaps 56 and 58 which act as dc blocking capacitors and is connected to a bonding pad 60 by a bond wire 61 which acts as a bias choke. A bias means, not shown, could also be connected to bonding pad 60. In FIG. 11 the input and output transmission lines to the transmission line switch are coplanar waveguide transmission lines formed by gaps 62 between center conductors 64 and 65 and ground plane conductors 66 formed on a dielectric substrate (such as alumina or fused silica); these conductors are connected by bonding straps 70 and 78 to the conductors 14 and 16 of a planar transmission line switch of the coplanar wave guide construction as illustrated in FIG. 2. The centerconductors 64 and 65 of the input and output transmission lines are d.c. isolated from each other by d.c. blocking capacitors formed by deposition of thin dielectric layers 80 (such as fused silica) between the overlapping metal conductors 64 and 65 as also shown in FIG. 12. At least one of the conductors 65 is connected to a bonding pad 90 by a bond wire 91 which acts as a bias choke. A bias means, not shown, could also be connected to bonding pad 90. Center conductor 16 of the coplanar attenuator and switch device illustrated in FIG. 11 is coupled to conductor 65 by means of straps 78; conductors 14 of the coplanar attenuator and switch device are coupled to conductors 66 by straps 70.

Figure 7:
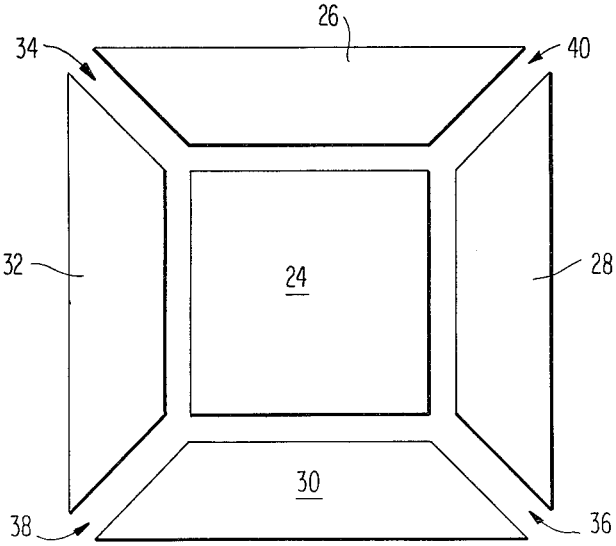
FIG. 7 is a schematic plan view illustrating the construction of a $\beta$ switching element using the transmission line attenuator and switch according to the invention.

Another multi-port network which can be realized using the advantages of the present invention is a switching element. Such an element is generally illustrated in FIG. 7 and comprises five metallic conductors deposited on a semiconductor substrate. The central conductor 24 has a generally square geometry and forms an ohmic contact with the substrate. Typically, this conductor is grounded. The other four conductors 26, 28, 30 and 32 are symmetrically arranged about the central conductor 24. Each of these conductors has a generally trapezoidal shape and are spaced from one another and the central conductors 24 to provide a uniform gap width. Each of the conductors 26, 28, 30 and 32 is made to form a Schottky barrier contact with the semi-conductor substrate. The gaps between adjacent ends of the conductors 26, 28, 30 and 32 define input or output ports of the r.f. transmission lines formed by the five metallic conductors. More specifically, the gap 34 between conductors 26 and 32 can be defined as an input port as can the gap 36 between the conductors 28 and 30. The output ports may be defined as the gaps 38 and 40 between the conductors 30, 32 and 26, 28, respectively. Reverse bias voltages are selectively applied to the conductors 26, 28, 30 and 32 to control the coupling of input r.f. signals at input ports 34 and 36 to the output ports 38 and 40. For example, if reverse bias voltages are applied to the conductors 26 and 30 while a slight forward bias is applied to conductors 28 and 32, an r.f. signal coupled to input port 34 will propagate to output port 40, while an r.f. signal coupled to input port 36 will propagate to output port 38. On the other hand, if reverse bias voltages are applied to conductors 28 and 32 while a slight forward bias voltage is applied to conductors 26 and 30, an r.f. signal coupled to input port 34 will propagate to output port 38, while an r.f. signal coupled to input port 36 will propagate to output port 40.

In all the embodiments heretofore discussed appropriate photolithographic techniques may be used to define the particular contact areas described. For example, the Schottky contacts may be metallized (such as the Schottky contacts 16 in FIG. 1) using one of the following techniques.

I. Evaporate aluminum on a flat surface of gallium arsenide (GaAs) substrate surface. This aluminum layer may be made as thick as can be done within the limits of practiceability to minimize the series resistance of the transmission lines.

II. Evaporate chromium on the GaAs surface then evaporate gold over the chromium. Again, the gold layer should be as thick as practical to make the series resistance of the transmission line minimal.

III. There are other metals or metal sequences that may be used. In general, one should use a metal or metal sequence which will adhere well and which will form a stable high conductivity conductor for the transmission line.

For the ohmic contacts such as that as contact 14 in FIGS. 1 and 8 there are several ways of making this contact to GaAs that are well known. One very good method is to evaporate a mixture of gold germanium and nickel onto the GaAs surface. This is followed by a heat treatment such as a 450° C. treatment for five minutes. Since the resulting metal does not have high conductivity, a pure gold layer may then be added over the heat-treated gold-germanium-nickel mixture. This may be done by evaporation or by electroplating techniques.

For the interconnections of the planar transmission line attenuator and switch device according to the invention with a passive transmission line circuit as shown in FIGS. 10, 11, and 12, the passive transmission lines such as heretofore described are formed by putting a metal layer on a dielectric transmission line substrate such as aluminum oxide ceramic (alumina) or fused silica. Two metallization methods are in common use and are acceptable. One is to evaporate aluminum on the dielectric substrate and the other method is to evaporate chromium or titanium on the dielectric substrate and then deposit gold over the chromium or titanium. These could be combined on the same dielectric substrate but gold and aluminum should not be allowed to come into contact because undesirable compounds of aluminum and gold may result.

If the transmission line attenuation and switch device according to the invention is to be interconnected into a circuit such as a crossbar switch as described above the material used in the device, the connecting wires, the straps, and the metal conductors on the passive transmission line must be compatible. For example, if both ohmic contacts and Schottky barrier contacts on the attenuation and switch device of the invention have a gold layer on their exposed surface, then all the metallized areas on the passive transmission line circuit should have a gold surface also, and the interconnecting wires and straps should be gold. If, on the other hand, the ohmic contacts have gold surfaces but the Schottky barrier contacts of the attenuating and switch device of the invention have aluminum surfaces, certain areas of the passive transmission line surface should be gold surfaces and certain areas should have aluminum surfaces. Specifically, in FIG. 10, if the device of FIG. 5 is used as the transmission line attenuating and switch device, and ohmic contacts 22 have a gold surface and Schottky barrier contacts 20 have an aluminum surface, the gap line conductor 48 of the passive transmission line circuit should have a gold surface and the interconnecting strap 72 to the ohmic contact 22 of the transmission line attenuating and switch device should be gold. Metal conductors 52 and 60 should have aluminum surface and the strap 74 and wire 61 should be aluminum. Conductor 50 is preferably of the same material as the conductor 48. In practice another wire (not shown) should also be bonded to conductor 60 to provide DC dias. This wire should also be aluminum. If in FIG. 11 the device of FIG. 2 is used, and ohmic contact 14 has a gold surface and Schottky contact 16 has an aluminum surface then areas 65 and 90, strap 78, and wire 91 and the bias wire (not shown) also bonded to area 90 should all be aluminum. Area 66 should have a gold surface and strap 70 should be gold. Area 64 should either be gold or an aluminum surface depending on what kind of metal is to be attached to it.

What is claimed is:

1. A beta element switching device comprising:

a semiconductor substrate having a planar surface, five metallic conductors deposited on said planar surface and spaced to form uniform gaps therebetween, one of said metallic conductors having a generally square geometry and the other four of said metallic conductors having a generally trapezoidal geometry and being symmetrically arranged about said one of said metallic conductors, the gaps between adjacent ones of said conductors defining shunt current paths between the adjacent conductors through said semiconductor layer, said one of said metallic conductors forming an ohmic contact to said semiconductor layer while said other four of said metallic conductors forming Schottky barrier contacts to said semi-conductor layer, adjacent ends of said other four of said metallic conductors defining input or output ports of r.f. transmission lines formed by said five metallic conductors, means for applying an r.f. signal to at least one input port to cause said r.f. signal to propagate toward one of at least two output ports, and bias means connected to each of said other four of said metallic conductors for selectively controlling the conductivity of said shunt current paths.

2. A beta element switching device as recited in claim 1 wherein said semiconductor substrate includes a layer of high resistivity semiconductor material upon which is formed a thin conductive semiconductor layer, said thin conductive semiconductor layer forming said planar surface.

3. A beta element switching device as recited in claim 1 wherein said semiconductor substrate includes a layer of low resistivity semiconductor material upon which is formed a thin conductive semiconductor layer, said thin conductive semiconductor layer forming said planar surface.

4. A beta element switching device as recited in claim 2 wherein the thickness of said conductive semiconductor layer is less than or equal to said depletion layer width at avalanche breakdown in said conductive semiconductor layer.

5. A beta element switching device as recited in claim 3 wherein the thickness of said conductive semiconductor layer is less than or equal to said depletion layer width at avalanche breakdown in said conductive semiconductor layer.

* * * * *

UNITED STATES PATENT AND TRADEMARK OFFICE

CERTIFICATE OF CORRECTION

PATENT NO. : 4,322,695

DATED : March 30, 1982

INVENTOR(S) : Paul L. Fleming et al.

It is certified that error appears in the above—identified patent and that said Letters Patent is hereby corrected as shown below:

Col. 1, line 37, delete "of" and insert --or--.

Col. 2, line 3, delete "a" (first occurrence).

Col. 3, line 35, delete "dc" and insert --d.c.--.

Col. 7, line 41, delete "or" and insert --of--.

Col. 7, line 46, delete "dc" and insert --d.c.--.

Col. 9, line 49, delete "dias" and insert --bias--.

Signed and Sealed this

*Twentieth* Day of *July 1982*

[SEAL]

*Attest:*

GERALD J. MOSSINGHOFF

*Attesting Officer*

*Commissioner of Patents and Trademarks*